United States Patent [19]

Ishii

[11] Patent Number: 4,502,388

[45] Date of Patent: Mar. 5, 1985

[54] PLATE HOLDING DEVICES FOR OFFSET DUPLICATOR

[75] Inventor: Koji Ishii, Fuchu, Japan

[73] Assignee: Ryobi Limited, Fuchu, Japan

[21] Appl. No.: 595,633

[22] Filed: Mar. 30, 1984

Related U.S. Application Data

[63] Continuation of Ser. No. 425,888, Sep. 28, 1982, abandoned.

[30] Foreign Application Priority Data

Sep. 30, 1981 [JP] Japan ..... 56-146232

[51] Int. Cl.[3] ..... B41F 27/12

[52] U.S. Cl. ..... 101/415.1

[58] Field of Search ..... 101/408, 409, 410, 411, 101/415.1

[56] References Cited

U.S. PATENT DOCUMENTS 2,813,482 11/1957 Mitchell et al. ..... 101/415.1
2,958,274 11/1960 Ritzerfeld et al. ..... 101/415.1
3,199,452 8/1965 Gericke ..... 101/415.1
3,719,142 3/1973 Abe ..... 101/415.1
4,359,941 11/1982 Fels ..... 101/415.1
4,391,193 7/1983 Ishii et al. ..... 101/415.1

*Primary Examiner*—Edgar S. Burr
*Assistant Examiner*—David A. Wiecking
*Attorney, Agent, or Firm*—Frishauf, Holtz, Goodman and Woodward

[57] ABSTRACT

A plate cylinder adapted to support a printing plate is provided with a pair of circumferentially spaced shoulders and an opening between the shoulders. A tail clamp member is mounted on one shoulder for clamping a tail edge of the printing plate, and a clamp plate for clamping a leading edge of the printing plate is hinged to the other shoulder and biased to a clamping position by a spring arrangement. Inner and outer operating plates are secured to a rotary shaft extending through a side surface of the plate cylinder, and a rotatable operating handle is provided near the side surface of the cylinder to engage the outer operating plate, thus causing the inner operating plate to swing the clamp plate.

7 Claims, 6 Drawing Figures

24a
24
1
2
3
4
5
7
8
10
11
11a
12
20a
25
26
27
42
50
51
52
53
60
61
63
70
71
72
73
80
81
82
83
100
II
III
V

PLATE HOLDING DEVICES FOR OFFSET DUPLICATOR

This application is a continuation of application Ser. No. 425,888, filed Sept. 28, 1982 now abandoned.

BACKGROUND OF THE INVENTION

The invention relates to a printing plate holding device for an offset duplicator.

With the prior art devices, when employing a straight printing plate formed with no perforations, control of distortion or lateral displacement of the plate cannot be carried out so that displacement tends to occur at the tail edge of the plate during printing operations, even if the plate has been accurately formed. Accordingly, it has been proposed in U.S. patent application Ser. No. 251,450, now U.S. Pat. No. 4,391,193, to control the lateral displacement and/or the distortion or twisting of the printing plate by controlling the axial and/or circumferential displacement of the clamp base, between which base and the clamp plate the edge of the printing plate is clamped. With this construction, however, as the clamp plate should be strongly urged against the clamp base in order to prevent the printing plate from being disengaged during the printing operations, the clamp plate is rapidly closed with a strong force when clamping the printing plate so that the printing plate tends to be clamped in a twisted state, and further, a strong force is required to open the clamp plate.

SUMMARY OF THE INVENTION

Accordingly, it is an object of this invention to provide an improved plate holding device for an offset duplicator capable of closing the clamp plate at a relatively low speed as well as opening it with a relatively small force, while maintaing its strong clamping force during the printing operations.

According to this invention, there is provided a plate holding device for an offset duplicator, comprising a plate cylinder rotatably supported by a machine frame and provided with two circumferentially spaced shoulders, a portion of the plate cylinder between said shoulders being removed to form an opening, a tail clamp member on one of the shoulders for clamping a tail edge of a printing plate, a clamp plate for clamping a leading edge of the printing plate, the clamp plate being hinged to the other one of the shoulders and biased to a clamping position by spring means, inner and outer operating plates both mounted on a rotary shaft extending through one side surface of the plate cylinder, a link bar for interconnecting the inner operating plate and the clamp plate, and an operating handle pivoted to the machine frame to engage the outer operating plate so as to swing the clamp plate via said rotary shaft, said inner operating plate and said link bar.

DESCRIPTION OF THE PREFERRED EMBODIMENTS

Figures 1, 3:
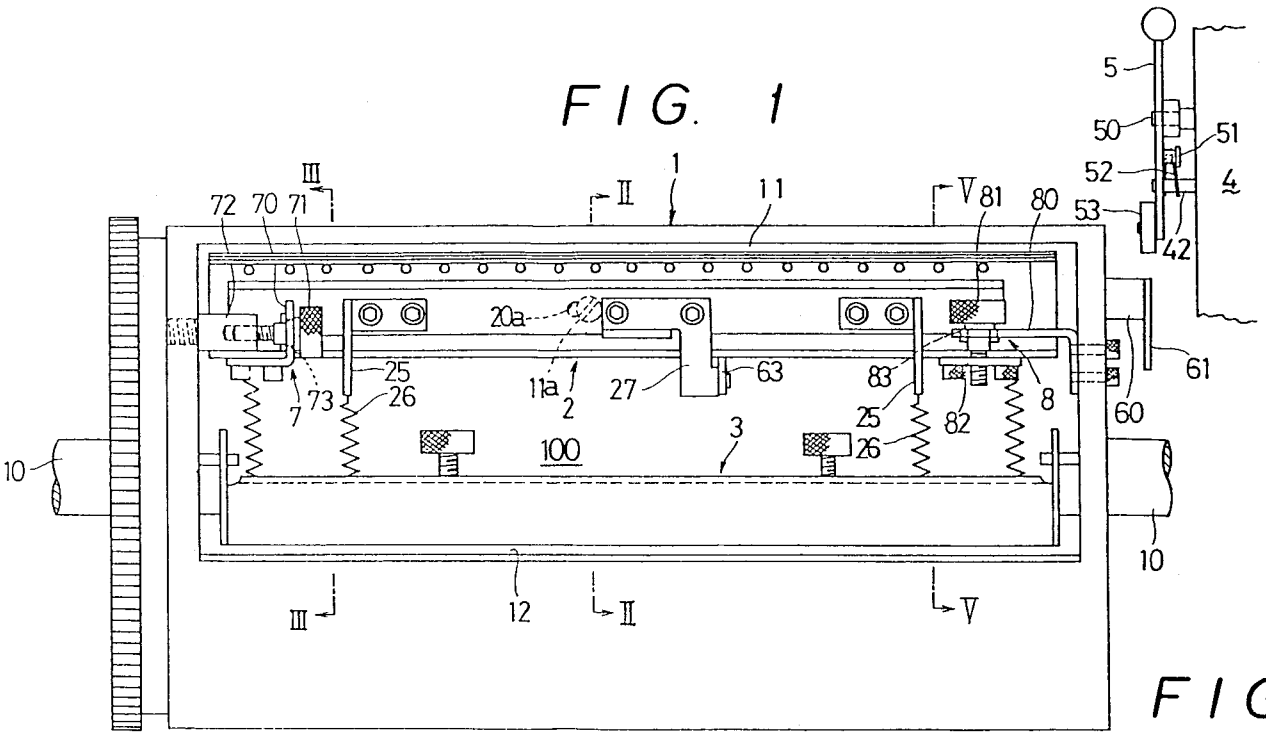
FIG. 1 is a front view showing a plate cylinder equipped with a plate holding device embodying the invention.
FIG. 3 is an enlarged view showing a plate for preventing disengagement of the printing plate holding device.

In a preferred embodiment of this invention shown in the accompanying drawings, a plate cylinder 1 is supported for rotation about its axis by shafts 10 journalled by a frame of an offset duplicator. The plate cylinder is formed with axially extending shoulders 11 and 12, a portion of the plate cylinder 1 being removed to form an opening 100 between the shoulders. A plate holding device 2 and a tail clamp device 3 are mounted on the shoulders 11 and 12 to oppose each other.

Figure 2:
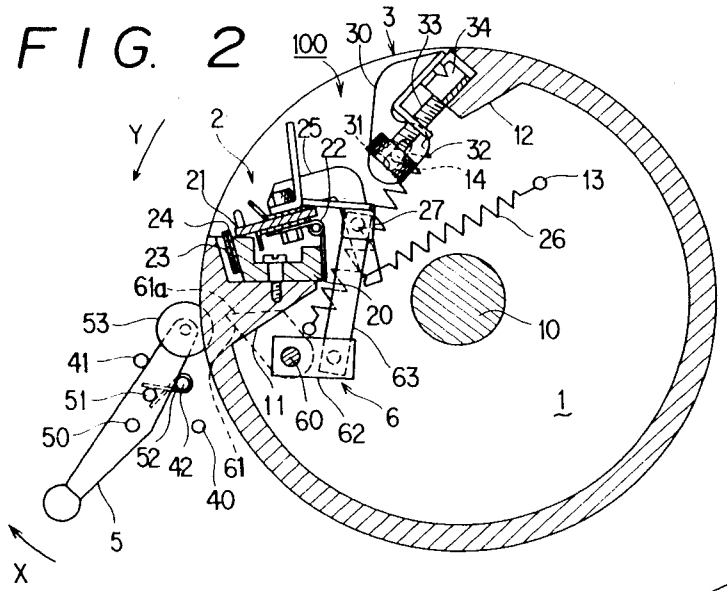
FIG. 2 is a sectional view of the plate cylinder taken along a line II—II in FIG. 1.

As shown in FIGS. 1 and 2, the plate holding device 2 comprises a clamp base 20 and a clamp plate 21 which are mounted on the shoulder 11. The clamp plate 21 is swingably mounted on the clamp base 20 by a hinge 22 provided at the rear end of the clamp plate 21. On the front side of the clamp base 20 are provided a guide plate 23 and a plate release preventing plate 24. As shown in FIG. 3, a plurality of thrust pawls **24*a* having pointed upper ends are formed on the upper edge of the preventing plate 24 at a predetermined spacing, as shown in FIG. 3. These pawls penetrate into the printing plate A inserted between the clamp base 20 and the clamp plate 21 to prevent withdrawal of the printing plate A. An inverted L-shaped arm 25 is secured to the upper surface of the clamp plate 21, and a free end of the arm 25 is normally urged against the clamp base 20 by a spring 26 provided between the opposite free end of the arm 25 and a stud on the plate cylinder 1**.

A handle lever 5 is pivoted to the machine frame 4 by a pivot pin 50 so as to be rotatable in the clockwise or counter-clockwise direction. The range of rotation of the lever 5 is limited by pins 40 and 41 secured to the machine frame 4. The lever 5 is urged to rotate in a given direction by a twisted hairpin spring 52 wound about a pin 42 projecting from the machine frame 4, so that the legs of the spring 52 encompass a pin 51 projecting from the lever 5. A roller 53 is mounted on the front end of the handle lever 5 to engage a link mechanism 6 arranged at one side of the plate cylinder 1. The link mechanism 6 includes a rotary shaft 60 inserted through the side surface of the plate cylinder 1, and outer and inner operating plates 61 and 62 which are secured to the shaft 60 on corresponding sides of said one side of the plate cylinder. The outer operating plate 61 has an inclined surface **61*a* which projects to a position engageable with the peripheral surface of the roller 53 of the handle lever 5, while the inner operating plate 62 on the inside of the plate cylinder 1 is connected, through a link bar 63, to a bracket 27 projecting from the clamp plate 21**.

Figure 4:
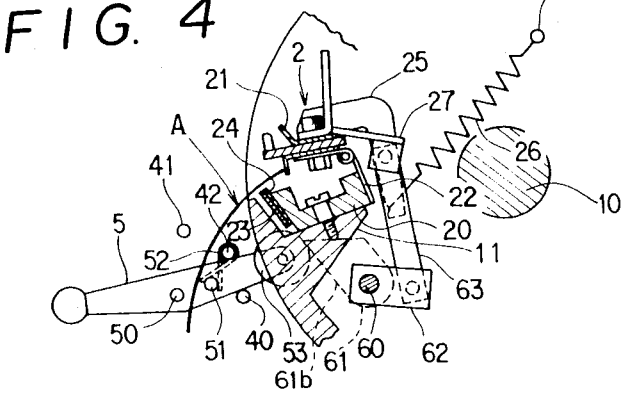
FIG. 4 is a view for explaining the operation of the plate holding device.

With the plate holding device constructed as above described, when the handle lever 5 is rotated in a direction X from the position shown in FIG. 2 to that shown in FIG. 4, and the plate cylinder 1 is then rotated in a direction Y, the operating plate 61 is urged by the roller 53 to rotate the rotary shaft 60 in the clockwise direction so that the clamp plate 21 is swung to its opened position against the biasing force of the spring 26 through the inner operating plate 62 and the link bar 63. On the contrary, when the plate cylinder 1 is rotated in the direction opposite to the direction Y from the position shown in FIG. 4 after inserting a printing plate A between the clamp plate 21 and the clamp base 20, the outer operating plate 61 slides on its side surface **61*b* along the round periphery of the roller 53 to be rotated in the counter-clockwise direction by the biasing force of the spring 26, so that the clamp plate 21 is swung to its closed position. Thus, the speed of the closing operation of the clamp plate 21 is controlled by the rotation speed of the plate cylinder 1. The plate cylinder 1 is rotated further to wrap the printing plate A about the plate cylinder 1. After one rotation thereof, the roller 53 is pushed by the inclined surface 61*a* of the operating plate 61 so that lever 5 returns automatically to the position shown in FIG. 2. Then, the plate tail edge is clamped by the tail clamp device 3. By the operations described above, the printing plate A is mounted on the plate cylinder 1. The twisted hairpin spring 52 performs a snap action for holding the lever 5 in a selected position shown either in FIG. 2 or FIG. 4**.

Figure 5:
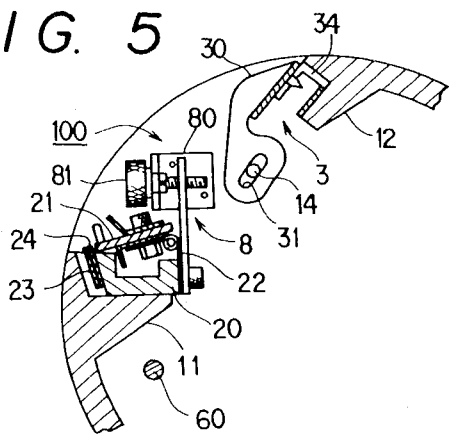
FIG. 5 is a cross-sectional view taken along a line V—V in FIG. 1.

A device shown in FIG. 5 may be used as the tail clamp device. In the modification shown in FIG. 5, a tail clamp plate 30 is slidably supported by a pin 14 secured to the plate cylinder 1, which pin 14 is received in a slot 31 of the tail clamp plate 30. The tail clamp plate 30 is biased rearward by a spring 32 (see FIG. 2). The contact portion between the tail clamp base 34 secured to the shoulder 12 of the plate cylinder 1 and the clamp plate 30, is adjustable by a bolt 33.

Figure 6:
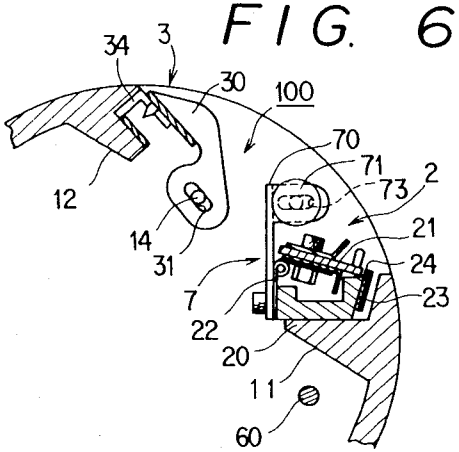
FIG. 6 is a cross-sectional view taken along a line III—III in FIG. 1.

In the embodiments illustrated, an axial displacement control device 7 and a circumferential displacement control device 8, are provided for correcting the longitudinal and lateral directions of the plate A clamped to the plate cylinder 1, as shown in FIGS. 5 and 6. According to these devices, a pin **11*a* secured to the shoulder 11 is received in a slot 20*a* formed through the clamp base 20 so as to permit the plate holding device 2 to slide or swing about the pin 11*a* for effecting fine adjustments. These devices 7 and 8 include adjusting knobs 71 and 81 respectively inserted loosely through brackets 70 and 80. By threading adjusting knobs 71 and 81 into or out of nuts 72 and 82 secured to the plate cylinder 1 or clamp base 20, the position of the plate holding device 2 on the shoulder 11 is adjustable by pin 11*a* and slot 20*a*. For the purpose of laterally moving the plate holding device 2 with the axial displacement control device 7, the bracket 80 of the circumferential displacement device 8 is provided with a slot 83 that loosely receives the adjusting nut 81. Furthermore, for the purpose of swinging, in the longitudinal direction, the plate holding device 2 with the device 8, a longitudinal slot 73 is provided for the bracket 70 of the device 7**.

As above described, according to the plate holding device of the present invention, as the clamp plate can be closed at a relatively low speed upon rotation of the plate cylinder, the clamp plate can strongly clamp the printing plate without slip thereof. Furthermore, the clamp plate can be opened with a relatively low force.

What is claimed is:

1. A plate holding device for an offset duplicator, comprising:

a machine frame;

a plate cylinder supported for rotation about its axis by the machine frame and having a pair of axially extending, circumferentially spaced shoulders, a portion of said plate cylinder between said shoulders being removed to form an opening;

a tail clamp member on one of the shoulders for clamping a tail edge of a printing plate;

a clamp plate for clamping a leading edge of the printing plate, the clamp plate being hinged to the other one of the shoulders;

first spring means associated with the plate cylinder for biasing the clamp plate to a clamping position;

a rotation shaft supported to extend through one side surface of the plate cylinder for rotation about the axis of the rotation shaft;

an inner operating plate fixed to the rotation shaft inside the plate cylinder;

a link bar inside the plate cylinder for interconnecting the inner operating plate and the clamp plate so that the clamp plate is operated in response to rotation of the inner operating plate by the rotation shaft;

an outer operating plate fixed to the rotation shaft outside the plate cylinder in the region of said one side surface of the plate cylinder, the outer operating plate having a first side surface wherein a force applied to said first side surface causes the rotation shaft to rotate in a direction to open the clamp plate;

an operating handle pivoted to the machine frame to engage the outer operating plate so as to swing the clamp plate through the rotation shaft, the inner operating plate and the link bar when the operating handle is pivoted from an initial to an operating position; and handle setting means on the machine frame for fixing the operating handle at a selected one of the initial and the operating positions;

and the handle in its operating position and the outer operating plate comprising means for actuating the clamp to open as the plate cylinder is rotated in a given direction and also for actuating the clamp to close as the plate cylinder is rotated in a direction opposite said given direction.

2. The plate holding device according to claim 1, wherein said handle setting means comprises pins on the machine frame for limiting rotation of said operating handle, and second spring means provided between said machine frame and said operating handle for biasing said operating handle to rotate toward the selected one of the initial and the operating positions.

3. The plate holding device according to claim 1 which further comprises a roller mounted on said handle to engage said outer operating plate.

4. The plate holding device according to claim 1, wherein said tail clamp member comprises a tail clamp plate slidably supported by said plate cylinder, and third spring means for biasing said tail clamp plate to an inoperative position.

5. The plate holding device according to claim 1 which further comprises means for finely adjusting longitudinal and lateral positions of said printing plate mounted on said plate cylinder.

6. The plate holding device according to claim 1 which further comprises a member for preventing disengagement of said printing plate mounted on said plate cylinder, said member being provided with a plurality of spaced sharp projections which pierce into said printing plate.

7. The plate holding device according to claim 1, wherein the outer operating plate has a second side surface for engaging the operating handle when the handle is at its operating position, to pivot the handle to its initial position when the clamp plate is at the clamping position and the plate cylinder is rotated in a direction opposite said given direction.

* * * * *